United States Patent [19]

Matsuda

[11] 4,419,868

[45] Dec. 13, 1983

[54] WARP-KNIT STRINGER TAPE FOR SLIDE FASTENER

[75] Inventor: Yoshio Matsuda, Nyuzen, Japan

[73] Assignee: Yoshida Kogyo K. K., Tokyo, Japan

[21] Appl. No.: 302,608

[22] Filed: Sep. 15, 1981

[30] Foreign Application Priority Data

Sep. 10, 1980 [JP] Japan ..... 55-132995[U]
Dec. 9, 1980 [JP] Japan ..... 55-176402[U]

[51] Int. Cl.[3] ..... D04B 21/00
[52] U.S. Cl. ..... 66/195; 66/196
[58] Field of Search ..... 66/195, 190, 191, 192, 66/193, 194, 196; 24/205.16 R, 205.16 C, 205.1 C

[56] References Cited

U.S. PATENT DOCUMENTS 4,051,579 10/1977 Heimberger ..... 66/195

FOREIGN PATENT DOCUMENTS 51-135709 of 1976 Japan ..... 66/195 UX

*Primary Examiner*—Ronald Feldbaum
*Attorney, Agent, or Firm*—Hill, Van Santen, Steadman & Simpson

[57] ABSTRACT

A warp-knit stringer tape for slide fasteners has a wale-free coarse region extending between a pair of longitudinal warp-knit webs for easy attachment to a knit fabric. The two webs are interconnected by a connector thread extending transversely across the wale-free region. The innermost wale and the next one or two in each web are disposed closely to one another, thereby providing a widened and thus reinforced wale along the wale-free region. No heavy or thickened yarns are used for the chain stitches of the innermost opposite wales of the webs, and hence there appear no bulged or increased-thickness wales along the wale-free region.

12 Claims, 8 Drawing Figures

WARP-KNIT STRINGER TAPE FOR SLIDE FASTENER

BACKGROUND OF THE INVENTION

1. Field of the Invention

The present invention relates to a warp-knit stringer tape for slide fasteners suitable for use on knit fabrics.

2. Prior Art

A warp-knit stringer tape for slide fasteners has been proposed which has a wale-free coarse region extending between a pair of transversely spaced longitudinal warp-knit webs for venting air or easy attachment to a knit fabric, there being a connector thread interconnecting the innermost opposite wales (of chain stitches) of the two webs across the wale-free region. The innermost wales include heavy or thickened yarns such as reinforced yarns to strengthen or reinforce the opposite edges of the webs along the wale-free region. However, because of such thickened yarns each web objectionably bulges at the reinforced edge portion thereof and hence has uneven surfaces, thus making the stringer tape unsightly.

SUMMARY OF THE INVENTION

According to the present invention, a warp-knit stringer tape for slide fasteners includes a pair of longitudinal warp-knit webs spaced transversely from one another with a wale-free region therebetween and interconnected by a connector thread extending across the wale-free region. To strengthen or reinforce the inner opposite edges of the webs along the wale-free region, the innermost wale and the next one or two in each web are disposed closely to one another. With this arrangement no heavy or thickened yarns are required for the innermost opposite wales of the webs, and therefore, there appear no bulged or increased-thickness wales along the wale-free region.

It is accordingly an object of the invention to provide a warp-knit stringer tape for slide fasteners in which a pair of webs has even surfaces with no bulged wales along a wale-free region.

Another object of the invention is to provide a warp-knit stringer tape for slide fasteners in which a pair of webs is sufficiently reinforced at their inner opposite edges along a wale-free region.

Still another object of the invention is to provide a warp-knit stringer tape for slide fasteners which is sufficiently resistive to a twist, particularly in a second web of the tape, thereby enabling easy and proper attachment of the slide fastener to a knit fabric, at which time the stringer tape can be put on a row of knitting needles without obstruction.

Many other advantages, features and additional objects of the present invention will become manifest to those versed in the art upon making reference to the detailed description and the accompanying drawings in which several preferred embodiments incorporating the principles of the present invention are shown by way of illustrative example.

DETAILED DESCRIPTION

Figure 1:
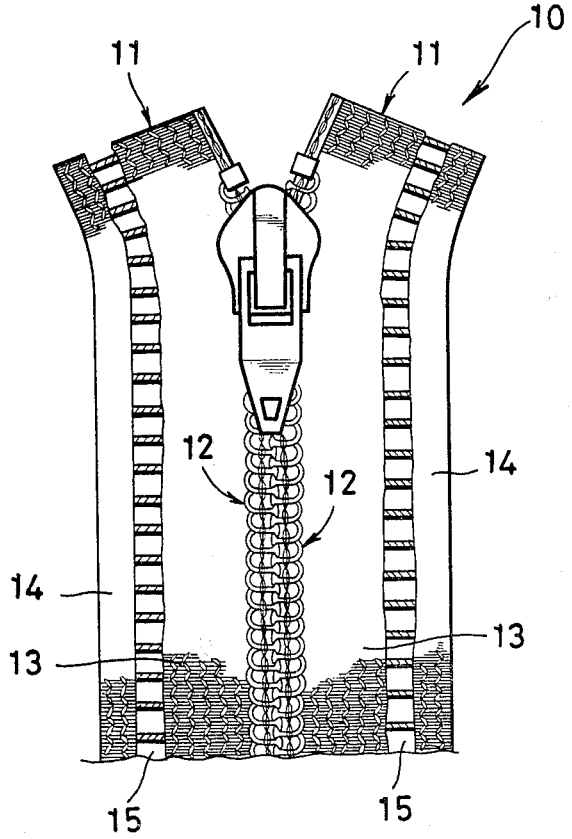
FIG. 1 is a fragmentary plan view of a slide fastener having a pair of warp-knit stringer tapes each employing the present invention.

As shown in FIG. 1, a slide fastener 10 for use on a knit fabric (not shown) comprises a pair of stringers each including a warp-knit stringer tape 11 supporting on and along one longitudinal edge thereof a row of coupling elements 12. The stringer tape 11 has a pair of first and second longitudinal warp-knit webs 13,14 spaced transversely from one another with a wale-free coarse region 15 therebetween which is devoid of one or two wales. The wale-free coarse region 15, however, may be varied in width by selecting a suitable number of wales to be omitted therefrom.

Figure 2:
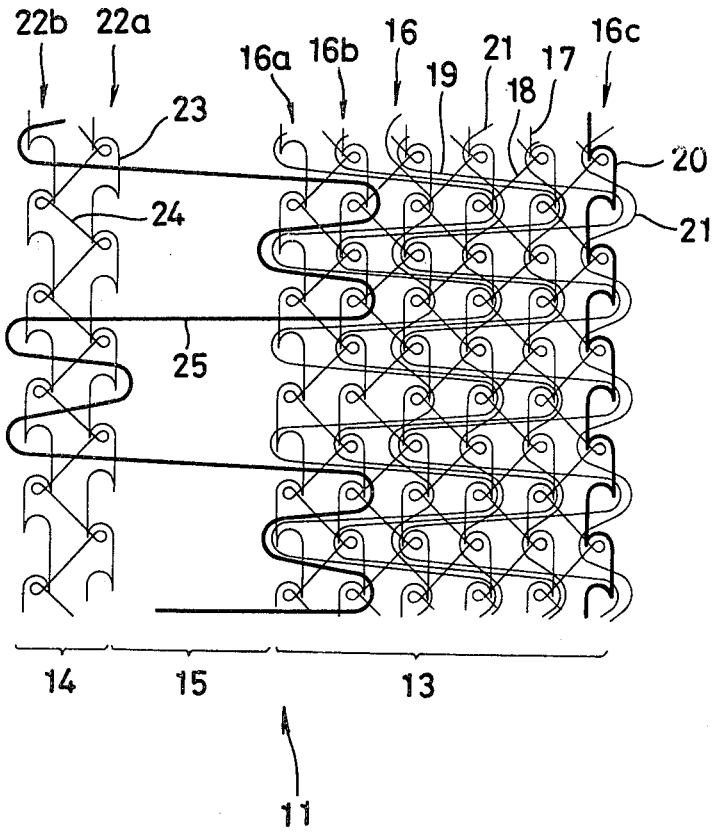
FIG. 2 is a point diagram for a warp-knit fabric structure of the tape according to a first embodiment.

As shown in FIG. 2, the first warp-knit web 13 has a plurality of longitudinal wales 16 which include chain stitches 17 having a pattern of 1-0/0-1. The first web 13 also includes tricot stitches 18 having a pattern of 1-2/1-0, a plurality of weft threads 19 laid in a pattern of 0-0/4-4, and a plurality of warp threads 21 laid in a pattern of 0-0/1-1. The outermost wale **16*c*, along which a row of coupling elements 12 (FIG. 1) is to be supported, includes chain stitches of a reinforced yarn 20. The second warp-knit web 14 has a pair of longitudinal wales 22*a*,22*b* which includes chain stitches 23 having a pattern of 1-0/0-1. The second web 14 also includes tricot stitches 24 having a pattern of 1-2/1-0. At the wale-free coarse region 15 two wales are omitted therefrom. The laid-in weft thread 19** may have an alternative pattern of 0-1/4-3.

The first and second webs 13,14 are interconnected by a connector thread 25 comprising a reinforced yarn laid in a pattern of 0-0/2-2/0-0/6-6/4-4/6-6. The connector thread 25 thus laid in extends transversely across the wales **22*a*,22*b* of the second web 14, the wale-free region 15, and an adjacent pair of the wales 16 of the first web 13 along the wale-free region 15, i.e. the innermost wale 16*a* and the next wale 16*b*. The innermost wale 16*a* is pulled by the connector thread 25 into contact with or closely to the next wale 16*b*, while the wales 22*a* and 22*b* are pulled by the same connector thread 25 into contact with or closely to one another, thereby providing a pair of opposite widened and thus reinforced wales along the wale-free region 15. Since no heavy or thickened yarns such as reinforced yarns are used for the chain stitches of the wales 16*a*,16*b*,22*a*,22*b*, the resultant warp-knit stringer tape 12 has literally even surfaces with no bulged wales in the webs 13,14 along the wale-free region 15**.

With this arrangement it is possible to strengthen or reinforce the inner opposite edges of the first and second webs 13,14 sufficiently without using reinforced yarns for the chain stitches of the wales 16*a*,22*a* along the wale-free region 15.

Figure 3:
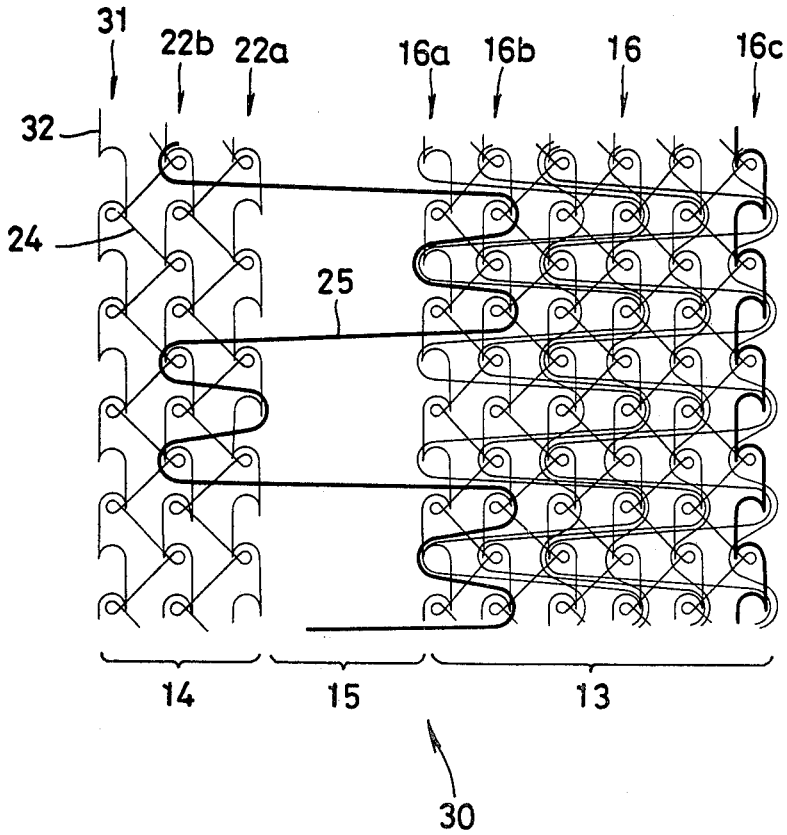
FIG. 3 is a point diagram for a warp-knit fabric structure of a modified stringer tape according to a second embodiment.

FIG. 3 illustrates a modified warp-knit stringer tape 30 according to a second embodiment. The stringer tape 30 has a warp-knit structure similar to that of the stringer tape 11 of FIG. 2 and is different therefrom only in that the second warp-knit web 14 includes an additional wale 31 of chain stitches 32 which extends along the outer edge of the web 14. With the stringer tape 30, just the same results as the embodiment of FIG. 2 can be achieved.

Figure 4:
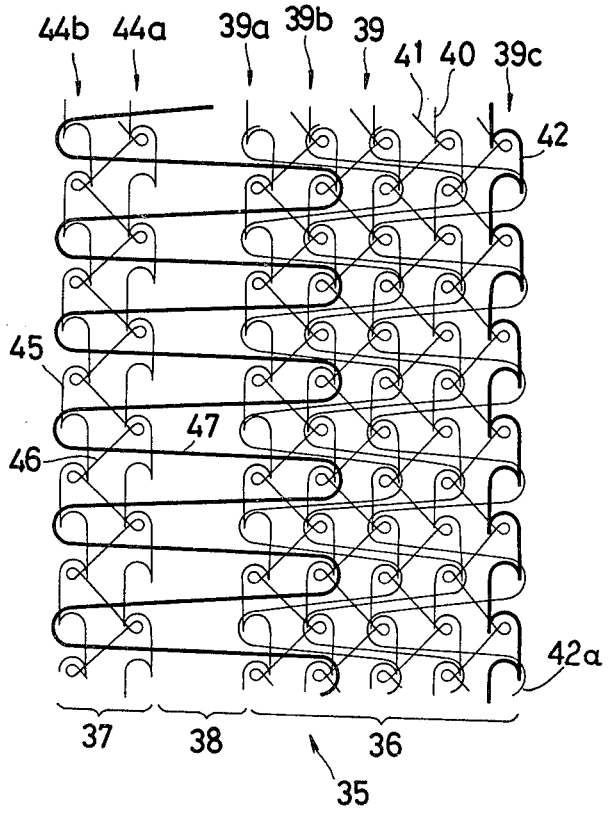
FIG. 4 is a point diagram for a warp-knit fabric structure of a modified stringer tape according to a third embodiment.

FIG. 4 illustrates a warp-knit stringer tape 35 according to a third embodiment. The stringer tape 35 has a pair of first and second longitudinal warp-knit webs 36,37 spaced transversely from one another with a wale-free coarse region 38 therebetween which is devoid of a single wale. The first warp-knit web 36 has a plurality of longitudinal wales 39 which include chain stitches 40 having a pattern of 1-0/0-1. The first web 36 also includes tricot stitches 41 having a pattern of 1-2/1-0, and a plurality of weft threads 42 laid in a pattern of 0-0/3-3. The outermost wale 39*c*, along which a row of coupling elements 12 (FIG. 1) is to be supported, includes chain stitches of a reinforced yarn 42. The second warp-knit web 37 has a pair of longitudinal wales 44*a*,44*b* which includes chain stitches 45 having a pattern of 1-0/0-1. The second web 37 also includes tricot stitches 46 having a pattern of 1-2/1-0.

The first and second webs 36,37 are interconnected by a connector thread 47 comprising a reinforced yarn laid in a pattern of 0-0/5-5. The laid-in connector thread 47 may have an alternative pattern of 0-0/0-0/5-5/5-5. The connector thread 47 thus laid in extends transversely across the wales 44*a*,44*b* of the second web 37, the wale-free region 38, and an adjacent pair of the wales 39 of the first web 36 along the wale-free region 38, i.e. the innermost wale 39*a* and the next wale 39*b*. The wales 39*b* and 44*b* are pulled by the connector thread 47 into contact with or closely to the innermost wales 39*a* and 44*a*, respectively, thereby providing a pair of opposite widened and thus reinforced wales along the wale-free region 38. Since no heavy or thickened yarns such as reinforced yarns are used for the chain stitches of the wales 39*a*,39*b*,44*a*,44*b*, the resultant warp-knit stringer tape 35 has literally even surfaces with no bulged wales in the webs 36,37 along the wale-free region 38.

With this arrangement, like the embodiments of FIGS. 2 and 3, it is possible to reinforce the inner opposite edges of the first and second webs 36,37 sufficiently without using reinforced yarns for the chain stitches of the wales 39*a*,44*a* along the wale-free region 38.

Figure 5:
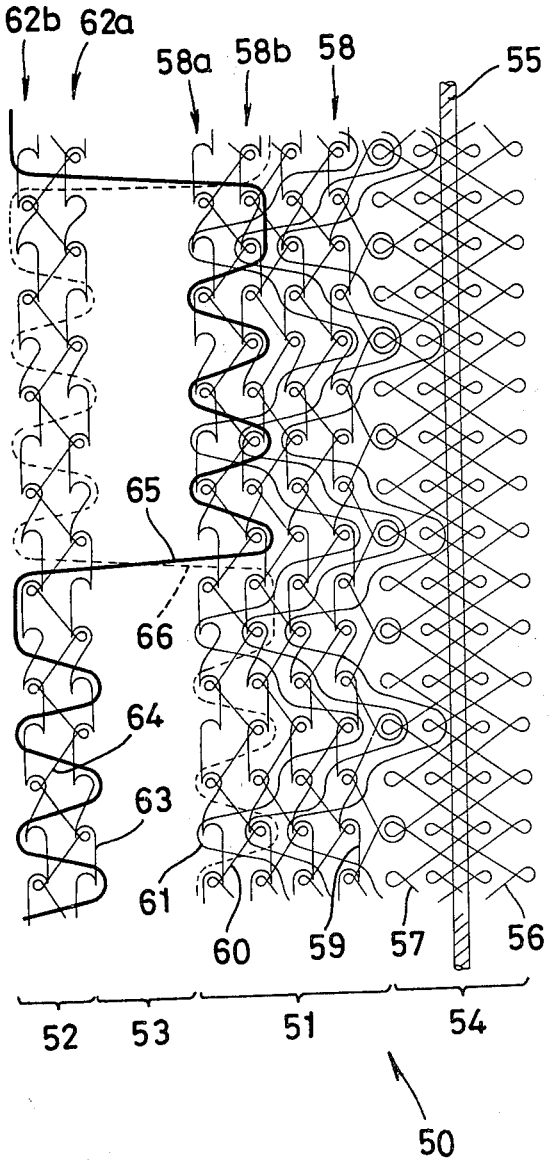
FIG. 5 is a point diagram for a warp-knit fabric structure of a double knit stringer tape according to a fourth embodiment.

FIG. 5 illustrates a warp-knit stringer tape 50 according to a fourth embodiment, which is made on a knitting machine having two needle beds and hence has a double knit structure. The stringer tape 50 has a pair of first and second longitudinal warp-knit webs 51,52 spaced transversely from one another with a wale-free region 53 therebetween which is devoid of two wales. The stringer tape 50 also has a beaded edge portion 54 along which a row of molded thermoplastic coupling elements (not shown) are to be mounted. The beaded edge portion 54 includes a core thread 55 laid in a pattern of 0-0/0-0, tricot stitches 56 having a pattern of 2-4/4-6, and tricot stitches 57 having a pattern of 4-6/2-0.

The first warp-knit web 51, which is contiguous to the beaded edge portion 54, has a plurality of longitudinal wales 58 which include chain stitches 59 having a pattern of 2-0/0-2/0-2/2-0. The first web 51 also includes tricot stitches 60 having a pattern of 2-4/2-0, and a plurality of weft threads 61 laid in a pattern of 4-4/8-8/4-4/0-0. The second warp-knit web 52 has a pair of longitudinal wales 62*a*,62*b* which includes chain stitches 63 having a pattern of 2-0/0-2/0-2/2-0. The second web 52 also includes tricot stitches 64 having a pattern of 2-4/2-0.

The first and second webs 51,52 are interconnected by a connector thread 65 comprising a reinforced yarn laid in a pattern of 8-8/12-12/8-8/12-12/8-8/12-12/12-12/0-0/4-4/0-0/4-4-/0-0/4-4/0-0/0-0/12-12. An additional connector thread 66 may be laid in a pattern of 4-4/0-0/4-4/0-0/4-4/0-0/0-0/12-12/8-8/12-12/8-8/12--12/8-8/12-12/12-12/0-0, as indicated by broken lines. Each of the connector threads 65,66 thus laid in extends transversely across the wales 62*a*,62*b* of the second web 52, the wale-free region 53, and an adjacent pair of the wales 58 of the first web 51 along the wale-free region 53, i.e. the innermost wale 58*a* and the next wale 58*b*. The wales 58*b* and 62*b* are pulled by the connector threads 65,66 into contact with or closely to the wales 58*a* and 62*a*, respectively, thereby providing a pair of opposite widened and thus reinforced wales along the wale-free region 53. Since no heavy or thickened yarns are used for the chain stitches of the wales 58*a*,59*b*,-62*a*,62*b*, the resultant warp-knit stringer tape 50 has literally even surfaces with no bulged wales in the wales 51,52 along the wale-free region 53. This arrangement would produce just the same results as the embodiments of FIGS. 2, 3 and 4.

Figure 6:
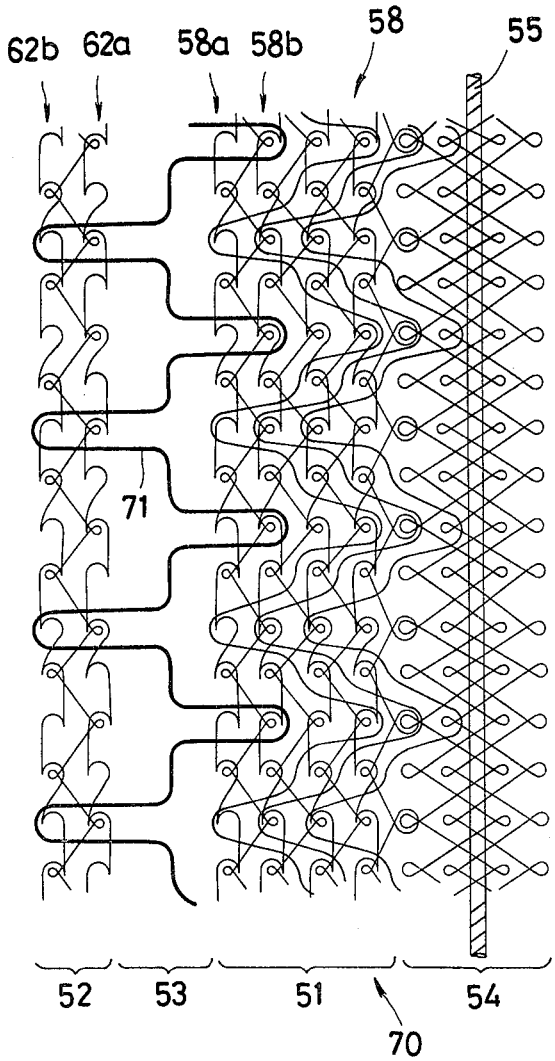
FIG. 6 is a view similar to FIG. 5, but showing a fifth embodiment.

FIG. 6 illustrates a modified warp-knit stringer tape 70 according to a fifth embodiment. The stringer tape 70 has a double knit structure similar to that of the stringer tape 50 of FIG. 5 and is different therefrom only in that the connector threads 65,66 are replaced by a single connector thread 71 laid in a pattern of 6-6/12-12/6-6/0-0, with the same results as the embodiment of FIG. 5.

Figure 7:
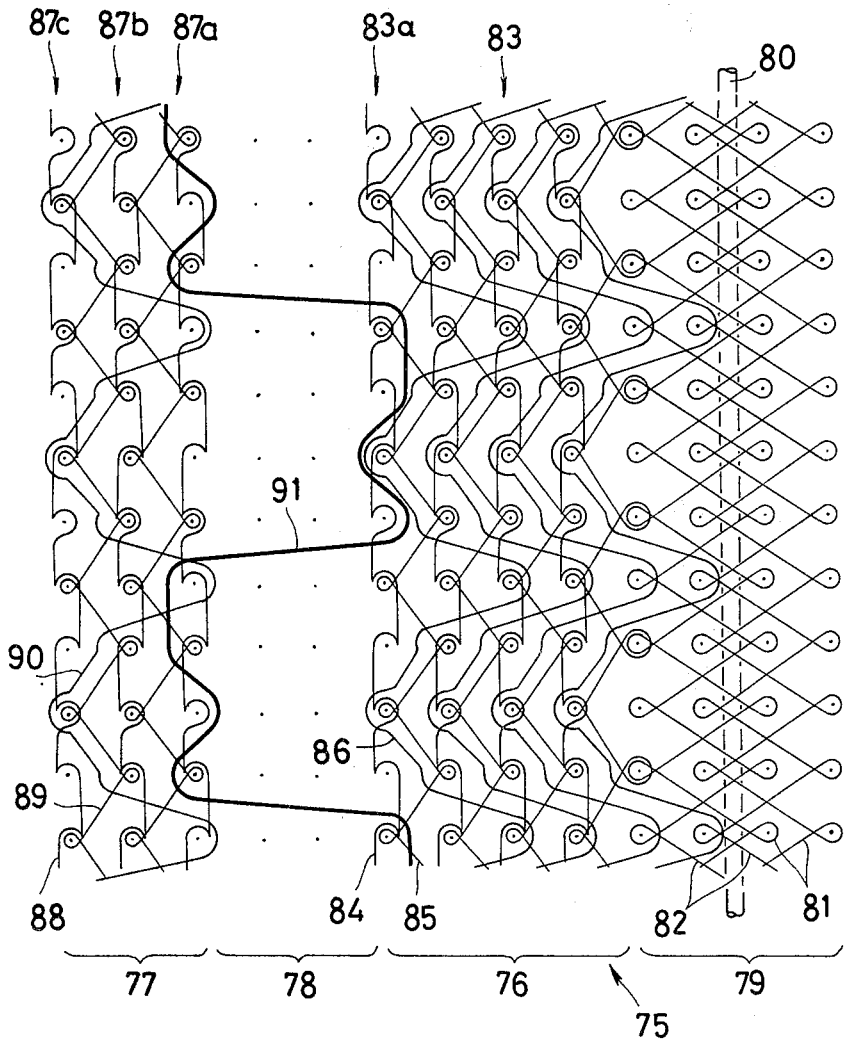
FIG. 7 is a point diagram for a warp-knit fabric structure of a modified double knit stringer tape according to a sixth embodiment.

FIG. 7 illustrates a warp-knit stringer tape 75 according to a sixth embodiment, which is made on a knitting machine having two guide bars and hence has a double knit structure. The stringer tape 75 has a pair of first and second webs 76,77 spaced transversely from one another with a wale-free coarse region 78 therebetween which is devoid of two wales. The stringer tape 75 also has a beaded edge portion 79 along which a row of molded thermoplastic coupling elements (not shown) are to be mounted. The beaded edge portion 79 includes a core thread 80 laid in a pattern of 0-0/0-0, tricot stitches 81 having a pattern of 2-0/4-6, and tricot stitches 82 having a pattern of 4-6/2-0.

The first warp-knit web 76, which is contiguous to the beaded edge portion 79, has a plurality of longitudinal wales 83 which include chain stitches 84 having a pattern of 2-0/0-2/0-2. The first web 76 also includes tricot stitches 85 having a pattern of 2-4/2-0, and a plurality of weft threads 86 laid in a pattern of 0-0/4-4/6-6/4-4. The second warp-knit web 77 has three longitudinal wales 87*a*,87*b*,87*c* which include chain stitches 88 having a pattern of 2-0/0-2/0-2. The second web 77 also includes tricot stitches 89 having a pattern of 2-4/2-0, and a weft thread 90 laid in a pattern of 0-0/4-4/6-6/4-4. The first and second webs 76,77 are interconnected by a connector thread 91 laid in a pattern of 0-0/8-8/6-6/8-8/8-8/0-0/2-2/0-0. The connector thread 91 thus laid in extends transversely between the innermost opposite wales 83*a* and 87*a* of the first and second webs 76,77 across the wale-free region 78.

At the second web 76 the two wales 87*b* and 87*c* are pulled by the laid-in weft thread 90 into contact with or closely to the innermost wale 87*a*, thereby providing a single widened and thus reinforced wale along the wale-free region 78.

Figure 8:
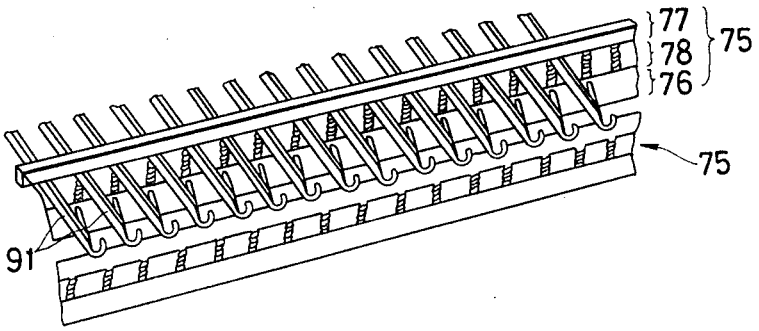
FIG. 8 is a fragmentary, schematic perspective view of a pair of warp-knit stringer tapes, illustrating the manner in which one of the tapes is put on a row of knitting needles.

Since no heavy or thickened yarns are used for the chain stitches of the wales 83*a*,87*a*,87*b*,87*c*, the resultant warp-knit stringer tape 75 has literally even surfaces with no objectionally bulged wales in the webs 76,77 along the wale-free region 73. Further, the stringer tape 75 is sufficiently resistive to a twist, particularly in the second web 76, thereby enabling easy and proper attachment of the slide fastener to a knit fabric (not shown), at which time the stringer tape 75 can be put on a row of knitting needles 91 (FIG. 8) without obstruction.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A warp-knit stringer tape for a slide fastener having a pair of rows of coupling elements, comprising:

(a) a first web for supporting along one longitudinal edge thereof one coupling element row of the slide fastener, said first web having a plurality of longitudinal wales of chain stitches;

(b) a second web spaced transversely from said first web with a wale-free region therebetween which is remote from said one longitudinal edge of said first web; and (c) a connector thread interconnecting said first and second webs across said wale-free region;

(d) a group (hereinafter called first group) of adjacent ones of said wales of said second web which extend along said wale-free region being disposed closely to one another.

2. A warp-knit stringer tape according to claim 1, a group (hereinafter called second group) of adjacent ones of said wales of said first web which extend along said wale-free region being disposed closely to one another.

3. A warp-knit stringer tape according to claim 2, said connector thread being laid in said first and second webs and extending transversely across said wales of said first and second groups and said wale-free region.

4. A warp-knit stringer tape according to claim 3, said laid-in connector thread having a pattern of 0-0/2-2/0-0/6-6/4-4/6-6.

5. A warp-knit stringer tape according to claim 3, said laid-in connector thread having a pattern of 0-0/5-5.

6. A warp-knit stringer tape according to claim 3, said laid-in connector thread having a pattern of 8-8/12-12/8-8/12-12/12-12/0-0/4-4/0-0/4-4/0-0/4-4/0--0/0-0/12-12.

7. A warp-knit stringer tape according to claim 6, including an additional connector thread laid in said first and second webs in a pattern of 4-4/0-0/4-4/0-0/4-4/0-0/0-0/12-12/8-8/12-12/8-8/12--12/8-8/12-12/12-12/0-0.

8. A warp-knit stringer tape according to claim 3, said laid-in connector thread having a pattern of 6-6/12-12/6-6/0-0.

9. A warp-knit stringer tape according to claim 1, said second web including a weft thread extending transversely across said wales of said first group.

10. A warp-knit stringer tape according to claim 9, said weft thread being laid in a pattern of 0-0/4-4/6-6/4-4.

11. A warp-knit stringer tape according to claim 9, said connector thread extending transversely between a pair of innermost opposite ones of said wales of said first and second webs across said wale-free region.

12. A warp-knit stringer tape according to claim 11, said connector thread being laid in a pattern of 0-0/8-8/6-6/8-8/8-8/0-0/2-2/0-0.

* * * * *